US011044987B2

(12) United States Patent
Salciarini et al.

(10) Patent No.: US 11,044,987 B2
(45) Date of Patent: Jun. 29, 2021

(54) COSMETIC PRODUCT APPLICATOR COMPRISING SUPPORTS

(71) Applicant: Chanel Parfums Beauté, Neuilly-sur-Seine (FR)

(72) Inventors: Christian Salciarini, Hyeres (FR); Sophie Argiolas, Argenteuil (FR)

(73) Assignee: Chanel Parfums Beauté

( * ) Notice: Subject to any disclaimer, the term of this patent is extended or adjusted under 35 U.S.C. 154(b) by 211 days.

(21) Appl. No.: 16/082,126

(22) PCT Filed: Mar. 1, 2017

(86) PCT No.: PCT/FR2017/050463

§ 371 (c)(1),
(2) Date: Sep. 4, 2018

(87) PCT Pub. No.: WO2017/149246

PCT Pub. Date: Sep. 8, 2017

(65) Prior Publication Data

US 2019/0387869 A1 Dec. 26, 2019

(30) Foreign Application Priority Data

Mar. 2, 2016 (FR) ..... 1651769

(51) Int. Cl.

| | |
|---|---|
| ***A46B 9/00*** | (2006.01) |
| ***A45D 40/26*** | (2006.01) |
| ***A46B 9/02*** | (2006.01) |

(52) U.S. Cl.

CPC ..... *A46B 9/005* (2013.01); *A45D 40/264* (2013.01); *A45D 40/267* (2013.01); *A46B 9/021* (2013.01); *A46B 2200/1053* (2013.01)

(58) Field of Classification Search

CPC .... A45D 40/26; A45D 40/262; A45D 40/264; A45D 40/265; A45D 40/267;

(Continued)

(56) References Cited

U.S. PATENT DOCUMENTS 4,527,575 A * 7/1985 Vasas ..... A45D 40/26 132/218
6,616,366 B1 * 9/2003 Weihrauch ..... A46B 9/021 401/286

(Continued)

FOREIGN PATENT DOCUMENTS

CN 101188958 A 5/2008
FR 2993441 A1 * 1/2014 ..... A46B 1/00

(Continued)

OTHER PUBLICATIONS

Open Cell Foam Vs. Closed Cell Foam_ Best Definitive Guide—FOAMTECH, file:///C:/Users/sraque1/Desktop/Patents/16082126/Open%20Cell%20Foam%20Vs.%20Closed%20Cell%20Foam_%20Best%20Definitive%20Guide%20%E2%80%93%20FOAMTECH.pdf (Year: 2017).*

*Primary Examiner* — Nicholas D Lucchesi
(74) *Attorney, Agent, or Firm* — St. Onge Steward Johnston & Reens, LLC

(57) ABSTRACT

The cosmetic product applicator comprising; protuberances, and at least three supports for said protuberances, the supports being arranged in a non-uniform manner along a longitudinal axis of said applicator.

17 Claims, 3 Drawing Sheets

(58) Field of Classification Search
CPC ..... A45D 34/042; A46B 9/021; A46B 2200/1046; A46B 2200/106; A46B 2200/1053
USPC ..... D28/7, 36; 132/320, 218
See application file for complete search history.

(56) References Cited

U.S. PATENT DOCUMENTS

| | | | | |
|---|---|---|---|---|
| 2006/0065282 | A1* | 3/2006 | Hartstock | A45D 34/042 132/320 |
| 2006/0272668 | A1* | 12/2006 | Wyatt | A45D 34/04 132/218 |
| 2008/0271746 | A1* | 11/2008 | Gueret | A45D 40/265 132/218 |
| 2012/0170965 | A1 | 7/2012 | Kulik et al. | |
| 2013/0276812 | A1 | 10/2013 | Kulik et al. | |
| 2014/0283868 | A1 | 9/2014 | Zech | |
| 2015/0327654 | A1* | 11/2015 | Pires | A46B 9/021 401/118 |
| 2016/0023388 | A1 | 1/2016 | Jacob et al. | |
| 2018/0220785 | A1* | 8/2018 | De Bardonneche | A46B 9/021 |
| 2019/0014895 | A1* | 1/2019 | De Bardonneche | A46B 9/028 |

FOREIGN PATENT DOCUMENTS

| | | | | |
|---|---|---|---|---|
| FR | 3014656 | A1 * | 6/2015 | A45D 40/267 |
| WO | 2006130642 | A1 | 12/2006 | |
| WO | WO-2006130642 | A1 * | 12/2006 | A45D 34/04 |
| WO | WO-2013153528 | A1 * | 10/2013 | A46B 9/021 |
| WO | WO-2020058645 | A1 * | 3/2020 | A46D 1/0253 |

* cited by examiner

COSMETIC PRODUCT APPLICATOR COMPRISING SUPPORTS

BACKGROUND OF THE INVENTION

A mascara article, or "mascara", typically comprises a case, a mascara container and an applicator. There are two types of applicator, bottle brush type and injected type. A bottle brush type applicator forms a brush which comprises bristles formed by fibres trapped in a twisted metal wire forming the core of the applicator. An injected applicator is a single piece and comprises plastic bristles or teeth. Such applicators give the user satisfactory results. However, the user is always looking for new or better make-up effects. For example, the user sometimes wants a "natural" make-up effect in which the separation of the eyelashes does not have an appearance that is too regular.

An object of the invention is therefore to improve the cosmetic product applicators.

SUMMARY OF THE INVENTION

The invention therefore relates to a cosmetic product applicator, comprising:

protuberances, and at least three supports for said protuberances, the supports being arranged in a non-uniform manner along a longitudinal axis of said applicator.

The non-uniform arrangement of the supports along the longitudinal axis of the applicator separates the eyelashes is a manner which is also non-uniform. This type of separation is particularly interesting since a "ruffled" effect is obtained, thereby giving the impression of thicker and longer eyelashes. This non-uniformity may for example correspond to supports separated two at a time by variable distances along the longitudinal axis of the applicator or to supports oriented in several different non-parallel directions.

In addition, due to its non-uniform structure, parts of the applicator have different configurations and can be used for different respective make-up movements or results. One of the parts may for example favour coating of the eyelashes with product, another the separation or curving of the eyelashes, yet another the thin make-up of certain areas.

The number of supports arranged in a non-uniform manner could be four, five, six or more.

The number of protuberances per support can be at least two. It can be for example three, four, five, six or more.

Preferably, at least one of the supports has a dimension and/or a shape that is different from the others.

This characteristic amplifies the phenomenon of non-uniformity and therefore further improves the make-up result. All the supports could have the same shape but each have a different dimension. Also, the supports could all have different shapes.

More preferably, all the supports have a dimension and/or a shape that is different from the other supports.

Advantageously, at least one of the supports has no axis of symmetry and/or no plane of symmetry.

This characteristic also amplifies the phenomenon of non-uniform separation of the eyelashes and therefore improves the make-up result by giving the eyelashes the impression of being thicker and longer. More particularly, the support has no symmetry relative to the longitudinal axis of the applicator or along a plane radial to this axis.

It may be provided that none of the supports have an axis of symmetry and/or a plane of symmetry.

It may be provided that there is no symmetry along a plane perpendicular to the axis between two supports of the applicator.

Preferably, at least one of the supports has a non-planar face.

More preferably, at least one of the supports has a non-ruled surface, all the supports preferably having a non-ruled face.

The supports have for example at least one concave portion and/or at least one convex portion. Once again, this characteristic helps to separate the eyelashes in a non-uniform manner, thus again helping to achieve the make-up result described previously.

Advantageously, at least one of the supports is generally leaf-shaped.

These leaves can have a generally wavy shape. In addition, their shape can be oblong, heart-shaped, lanceolate, oval, elliptical, deltoid or palmate.

Advantageously, at least one of the supports comprises at least two through-holes.

Thus, the cosmetic product carried by the support can flow through it so as to be distributed homogeneously on several faces of the support and between the various supports. The contour of these holes may have different general shapes. For example, the contours could have oval, circular, rectangular, oblong shapes or the contours could have no particular geometrical shape.

Preferably, at least one part of at least one of the supports is formed by a branching of branches, the branching forming the holes.

These branches could be elongated and extend towards the outside from a median portion of the support. Or the various branches of a support could join at their distal ends to form the holes of the support.

Preferably, the supports are distributed in pairs of adjacent supports along the longitudinal axis of the applicator, each support being closer to the support of the same pair than the other supports.

Grouping supports together creates portions of the applicator that have a higher density of supports than others and therefore a higher density of protuberances carried by these supports. Thus, the appearance of alternate portions of the applicator that have a higher or lower density of protuberances further increases the irregular appearance of the applicator. These groups could comprise more than two supports, for example three, four or five. The supports of a given pair could merge at least partly at a median portion of these supports forming their junction.

Preferably, the supports are made along the longitudinal axis of the applicator and at least two of the supports one after the other form a cell between them.

This cell can contain cosmetic product once the applicator has been removed from a product container. This cell therefore also forms a product reserve when the applicator has been removed from the container, thereby reducing the number of times that the user needs to reinsert the applicator into the container. The volume of this cell depends in particular on the distance separating the two supports forming it and the dimension of these supports. Thus, the farther apart these two supports, the greater the volume of the cell, and vice versa. In addition, the greater the dimension of these two supports, the greater the volume of the cell, and vice versa.

More preferably, the cell crosses a longitudinal axis of the applicator.

Distribution of the product around the entire longitudinal axis of the applicator is therefore improved. This distribution loads most of the applicator with product and avoids excessive accumulation of product in certain areas of the applicator, which could result in too much product being deposited on the eyelashes and the formation of clumps.

Advantageously, the applicator comprises at least two cells which communicate with each other via at least one hole in one of the supports.

Thus, the product contained in these cells is distributed homogeneously between the various cells in order to obtain a better make-up result. Preferably, the supports have in their median portions a through-hole which allows easier communication between the two cells between which the hole is located.

Preferably, the protuberances form spines extending from the support.

The purpose of these spines which extend the supports is to apply mascara to the eyelashes, comb them and separate them. They are for example thin and straight or slightly curved. These spines oriented in non-uniform directions increase the disorganised effect of the eyelashes. These spines could of course have different shapes, for example hooked, zigzag or helical.

Advantageously, the protuberances extending from a same support do not form a repetitive pattern.

Also advantageously, the protuberances of any one of the supports are not arranged in the same way as the protuberances of the other supports.

These two characteristics also help to achieve the disorganised effect of the eyelashes and the above-mentioned advantages.

Preferably, the applicator has no axis of symmetry and/or no plane of symmetry.

More particularly, the applicator has no axis of symmetry along the main longitudinal axis of the applicator and/or has no symmetry along a longitudinal plane or a horizontal plane. Once again, the disorganised effect is improved by this characteristic.

Advantageously, the applicator has no core.

This characteristic makes the applicator extremely flexible, in particular making application more comfortable for the user. In addition, if the applicator has cells, the flexibility of the applicator due to the lack of a core helps the product to come out of the cells when the user uses the applicator. The lack of a core implies that the applicator structure is self-supporting.

Preferably, the applicator comprises a thinned free end which is thinner than the rest of the applicator.

This characteristic makes it easier to insert the applicator into a case of the cosmetic product article. It also simplifies the make-up of short eyelashes and corrections during make-up.

Advantageously, the applicator has an open cell foam structure.

This structure gives the applicator greater flexibility, especially bending flexibility. This flexibility applies to the entire structure and in particular the envelope surface of the applicator, like a natural sponge. The protuberances are particularly flexible, which simplifies make-up. The applicator structure can also be qualified as open pore foam structure. This structure is formed by a network of branches which are connected to each other randomly at points distributed in the volume defined by the outer envelope of the brush.

The applicator could be made in one piece.

The advantage of a one-piece applicator is that it is faster to manufacture. The applicator may be made of a single material or of several different materials.

Several techniques are available to manufacture a one-piece applicator, for example injection moulding or additive synthesis.

The invention also provides for an applicator as illustrated on FIGS. 3A and 3B.

The invention further provides for a cosmetic article comprising an applicator as described previously.

The invention also provides for a method of manufacturing by additive synthesis an applicator as described previously, comprising the following steps:

obtaining data concerning the applicator; and additive synthesis of the applicator using the data.

The advantage of this type of manufacture is, in particular, that it can be used to produce applicators of complex structure, which it would be difficult or even impossible to produce by injection, considering in particular the existence of some parts with undercut.

Various additive synthesis methods known by those skilled in the art can be used to manufacture the invention. They include, for example, selective laser sintering (SLS) and stereolithography (SLA). An example of a method of manufacturing a cosmetic product applicator by additive synthesis is described in application WO 2008/113939 in the name of the applicant.

The invention also provides for a computer file comprising data that can be used by a computer program to control the implementation of the method as described previously.

The invention also provides for an electronic storage medium comprising stored data to implement the method as described previously.

Lastly, the invention also provides for a method of providing a file as described previously in order to download it on a telecommunication network.

BRIEF DESCRIPTION OF THE DRAWINGS

We will now describe one embodiment of the invention given as a non-limiting example in reference to the drawings, in which.

DETAILED DESCRIPTION OF THE INVENTION

Figure 1:
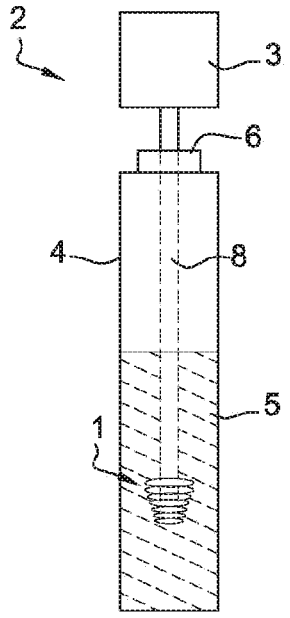
FIG. 1 is a schematic longitudinal cross-section of a cosmetic article according to one embodiment of the invention.
Figure 2:
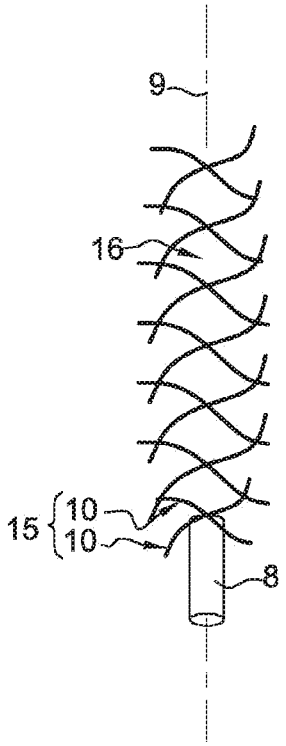
FIG. 2 is a schematic representation of the applicator of the article of FIG. 1.
Figure 3A:
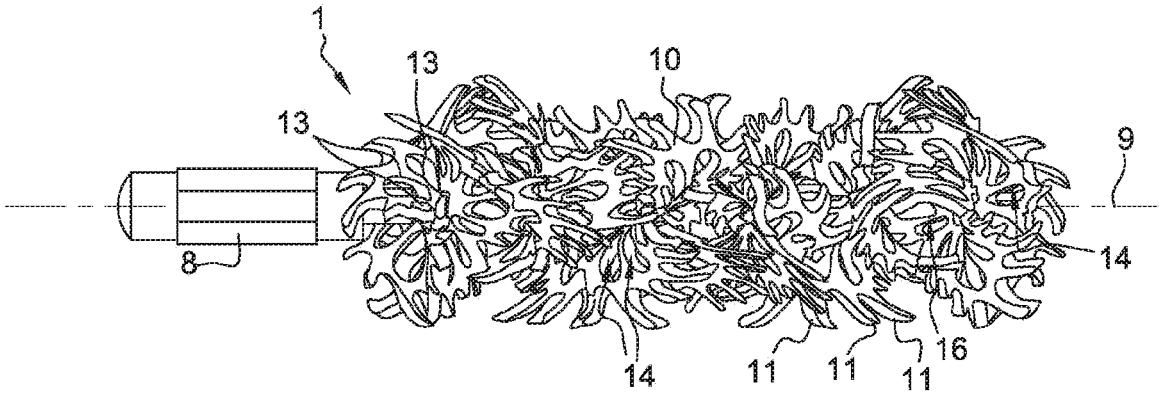
FIGS. 3A and 3B are respectively side and perspective views of the applicator of the article of FIGS. 1 and 2.
Figure 3B:
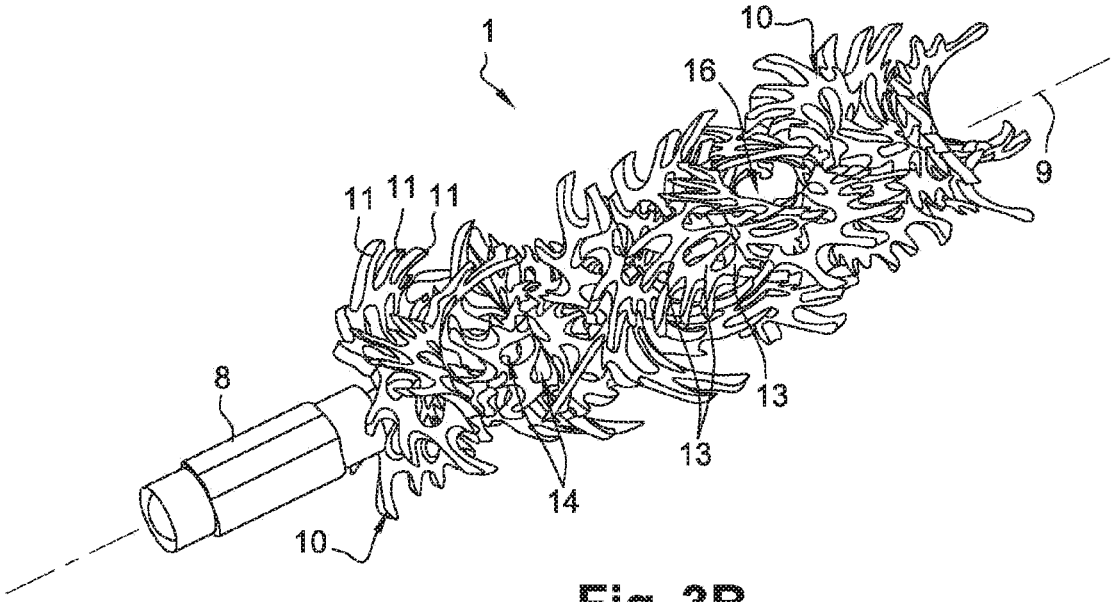
Figure 4:
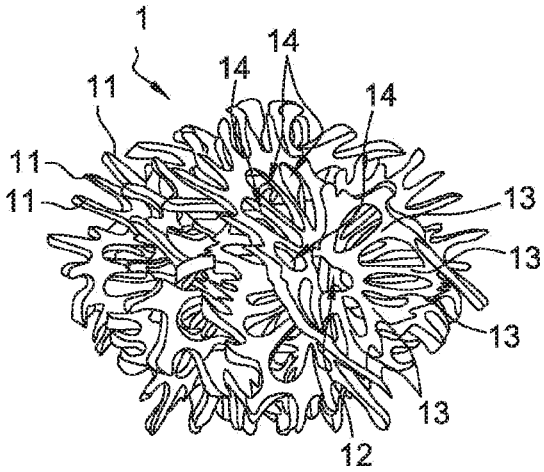
FIG. 4 is a view, from its free end, of the applicator of FIGS. 3A and 3B.
Figure 5A:
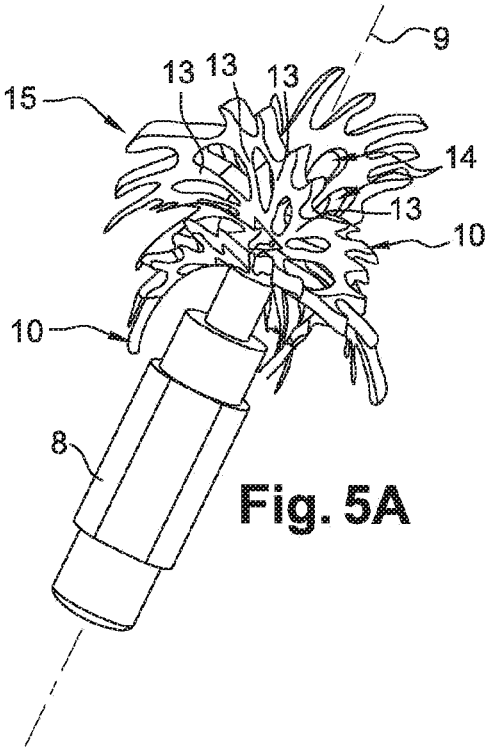
FIGS. 5A to 5D are perspective views of a proximal portion of the applicator of FIGS. 3A to 4 showing a pair of supports.
Figure 5B:
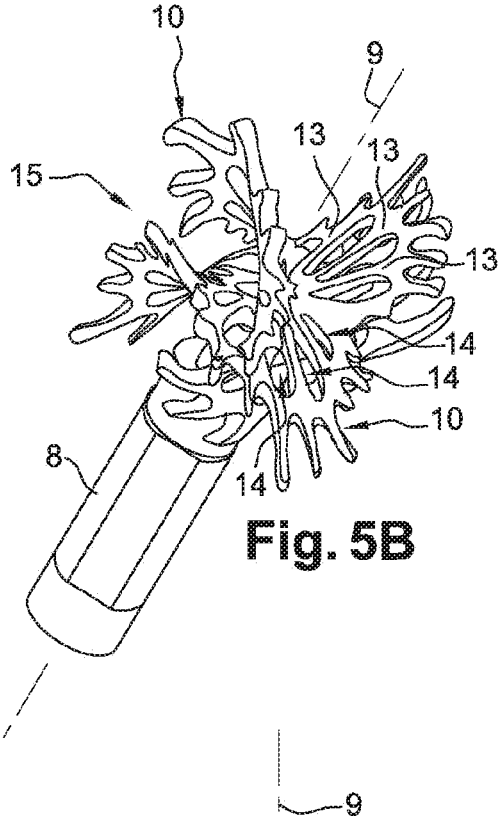
Figure 5C:
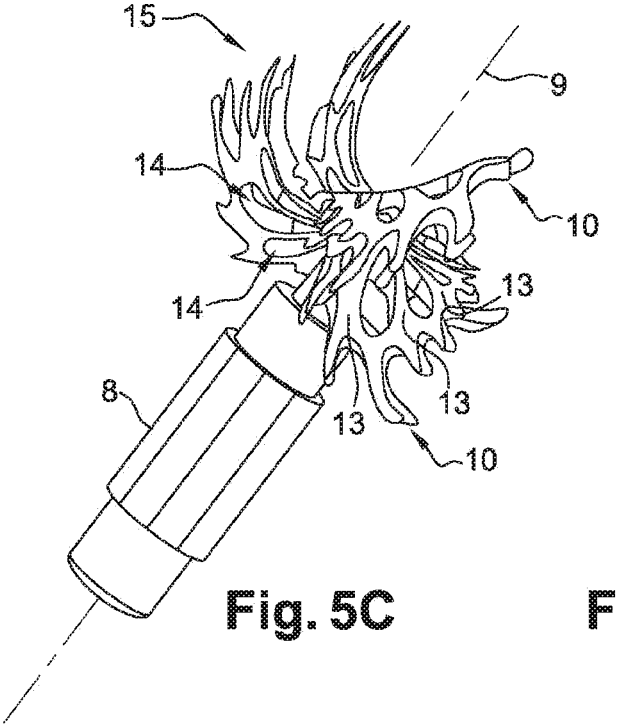
Figure 5D:
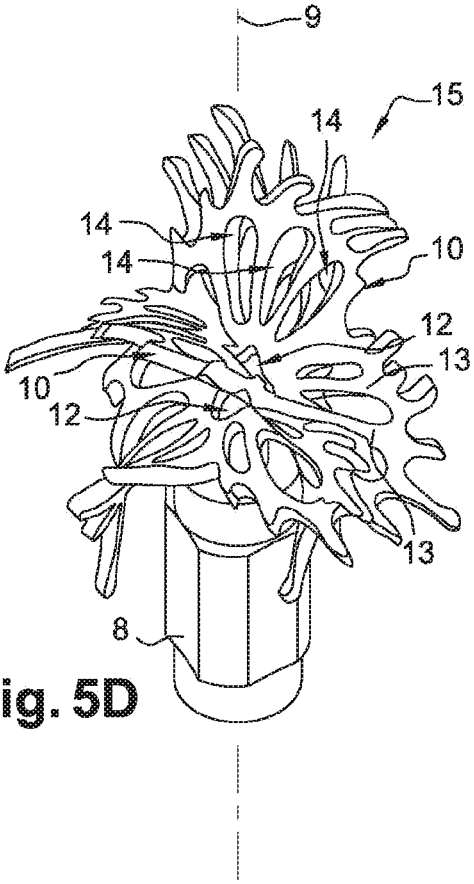

We will now describe an embodiment of the article and of the method according to the invention, in reference to FIGS. 1 to 5D. We will describe here a mascara applicator but, obviously, the applicator could be used with another cosmetic product, for example nail polish or lipstick.

The mascara applicator 1 described in this embodiment is part of a cosmetic article 2 comprising a cap or plug 3, to which the applicator 1 is rigidly attached, and a case 4 comprising a mascara container 5 and a wiper 6 (see FIG. 1) housed in a collar of the container on which the cap can be removably attached, for example screwed, to close the container and the article. The applicator thus extends in the container and is immersed in the mascara.

Obviously, other types of article with mascara applicators can be considered such as for example "pen" type articles in which the applicator is not connected to a cap or articles in which the applicator is not immersed in the mascara reserve when not used.

The applicator is carried by a rod 8 which connects it to the cap 3. The article has a cylindrical general shape of circular, square or elliptical cross-section, and is elongated along its longitudinal axis 9. The rod 8 has a cylindrical general shape and its longitudinal axis is coincident with the longitudinal axis 9 of the applicator. The rod and the applicator are connected together by one of their ends (see FIG. 3A).

The article could have other general shapes, for example a spherical, parallelepiped or cubic general shape.

The Applicator

The applicator comprises protuberance supports 10 and protuberances 11. In the present case, the applicator 1 comprises twelve protuberance supports 10, each comprising between ten and thirty protuberances 11. Obviously, the number of supports 10 and the number of protuberances may vary. There could be a lower number of supports, for example five, six, seven, eight, nine, ten, or eleven, or a greater number of supports, for example fourteen, fifteen, sixteen, seventeen, eighteen, etc. There could also be a greater number of protuberances on a same support, for example thirty-five, forty or forty-five, or a lower number, for example between one and ten.

Each support is flat in this case so as to have two faces opposite one another. In the present example, each face is non-planar and even non-ruled, and has one or more convex curves and/or one or more concave curves. One or some of the supports could have a non-ruled face. It may be provided that at least some of the supports are flat, or even that all the supports are flat.

In addition, none of the supports has a plane of symmetry or an axis of symmetry. All the supports are different from one another, both as regards their shape and their dimensions. Obviously, all the supports could be identical or at least some of the supports could be identical.

Some of the supports have for example the shape of a tile, saddle, portion of a cylinder, a cone or a torus. One of the supports can have one of these shapes and another support can have another of these shapes.

In the present case, each support 10 is in contact with at least one other support of the applicator and forms with it a junction at at least one point or even along a line or a curve.

The supports 10 are arranged in a non-uniform manner along the axis 9.

Each support 10 has in a median portion a central through-hole 12 from which several branches 13 extend. In the present case, the central holes 12 of the supports 10 are all located along the axis 9. At least one of the central holes 12 could not be located along the axis 9, or even all the central holes 12 could not be located along the axis 9. All the branches 13 of the support are branched two at a time so as to form holes 14 of elongate oval general shape between them. Obviously, the holes 14 could have a different general shape, for example circular, rectangular, oblong, or even have no particular shape.

The supports 10 are grouped in pairs 15 of adjacent supports (see FIGS. 5A to 5D). The supports of a given pair are globally closer to one another than other pairs of supports of the applicator. A pair 15 of supports 10 comprises two supports which follow one another directly along the axis 9 and which merge together, i.e. they have a common junction on at least a part of their respective median portions. In the present case, the applicator comprises six pairs 15 of supports which follow one another along the axis 9.

In this case, most of the supports of a given pair 15 are interlaced. More precisely, if we define an upper face and a lower face of the supports in a pair 15 comprising a proximal support and a distal support, one part of the proximal support will be opposite the upper face of the distal support, and another part of the proximal support will be opposite the lower face of the distal support. Obviously, it may be provided that none of the pairs 15 is composed of interlaced supports, or only some of the pairs are interlaced. There could also be groups of supports comprising a different number of supports 10. For example, there could be groups of three, four or five supports which all merge together at at least a part of their median portions.

Two successive pairs 15 define between them a cell 16. The applicator thus comprises five cells 16. The cell is formed by the curve of the supports of the respective pairs which are opposite one another.

Each cell 16 communicates with the cell immediately before it or after it along the axis 9. This communication takes place via the holes 12, 14 of the supports which form the cells. Obviously, there could be at least one of the cells 16 which does not communicate with any other cell. Each cell crosses the longitudinal axis 9 and thus forms a tunnel. Obviously, none of the cells could cross the axis or one or only some of the cells could cross this axis 9. In the present case, the directions of the cells are radial to the axis 9. The orientation could be different.

In an alternative embodiment, the cells could not be formed by two pairs 15 of supports but simply by two supports 10.

As already mentioned, each support 10 comprises between ten and thirty protuberances 11. These protuberances 11 have a generally curved or straight shape and form in this case spines which extend from the support. On a same support 10, at least one of the protuberances 11 has a shape and/or dimension and/or orientation different from those of the other protuberances. In the present case, each protuberance has a unique combination of these characteristics (shape, dimension and orientation) within the applicator. Several protuberances could have the same shape, dimension and orientation characteristics within an applicator.

Some, or even all, of the protuberances could be formed by fingers, bristles or strands rather than by spines.

The above characteristics give the applicator of this example a disorganised, irregular and ruffled shape. We observe in particular that the supports, like the protuberances, extend respectively in all directions. The same applies for the cells. We also note that it has numerous faces with undercut.

The applicator has no core, making it highly flexible and thus making application more comfortable for the user. This flexibility helps the product to come out of the cells when the user uses the applicator. The lack of a core implies that the applicator structure is self-supporting.

Using the Applicator

Initially, the user handles the applicator 1, holding the cap 3 between her fingers and inserts the applicator 1 into the mascara reserve 5 of the article 2. During this step, the cells 16, the holes 12, 14 as well as the supports 10 and the protuberances 11 are loaded with mascara.

When the applicator is removed from the container and therefore as it passes through the wiper 6, the applicator is wiped but the cells keep all or some of this mascara reserve. This wiping also helps to distribute the product in and on the applicator, the product being able to cross the holes and the cells.

During use, the user brings the applicator up to her eyelashes in order to apply the make-up, using a traditional make-up movement, mostly vertical. The mascara present on the spines 11 and on the supports 10 is thus deposited on the eyelashes. The spines 11 and the edges of the supports 10 smooth this deposited mascara in order to avoid the formation of clumps and also comb the eyelashes. Since each spine, and each support, has different dimensions and/or orientations and/or shapes, the eyelashes are combed in different directions, thus helping to achieve the required "ruffled" effect.

During application, the applicator behaves like a sponge due to its flexibility and releases mascara into the contact areas, i.e. into the application areas, which simplifies the make-up by reducing in particular the number of times that the user needs to reinsert the applicator into the container by directing the mascara into places where it is required.

More specifically, when the applicator 1 is pressed against an area of the eyelashes, it is compressed locally due to its flexibility. The mascara present in a cell 16 near this compression area is thus directed towards the application area. This mascara can spread in particular, from its cell 16 onto the support(s) 10 forming the cell then onto the spines 11 and is thus available for application. The holes 14, 12 of the supports also allow the mascara to spread from one support to another within the applicator, making it possible in particular to use mascara which is relatively far away from the application area.

The Manufacturing Method

The applicator described above is manufactured in one piece. More particularly, this applicator is manufactured in this case by additive synthesis, also known as 3D printing.

Any suitable material can be used to manufacture the applicator. It may be a plastic, for example a polyamide, in particular a polyamide 1102, a PEBA 2301, or an ABS type resin, or a powdered metal such as a stainless steel or titanium.

The material may be rigid but will preferably be elastically flexible. Preferably, the material, in combination with the applicator's shape characteristics, gives the applicator a certain degree of flexibility, in particular at the supports and especially at the protuberances.

Note that the length of a mascara applicator is generally less than 20 mm.

Several additive synthesis methods may be used to manufacture an applicator as described previously. We may mention in particular selective laser sintering from powdered material, and stereolithography (SLA). In the present case, a selective laser sintering method is used, this method offering the advantage of allowing objects of complex shape to be manufactured.

The applicator is first designed using computer-aided design (CAD) software. A file in STL format with the applicator design data is therefore created and then exported. This data determines the shape of the applicator. Other standard file formats for additive synthesis may be used.

This file is then processed by software supplied by the manufacturer of the machine used to carry out the additive synthesis. This software breaks down the file into sections in the form of about hundred digital images in SLI or BFF format, each image corresponding to a layer of the model to be printed, i.e. to a section of the applicator taken in a plane perpendicular to the axis 9. This data is then sent to the printer to produce the applicator.

Once the synthesis is finished, treatments may be applied to the applicator, for example to improve its appearance.

Obviously, numerous modifications can be made without leaving the scope of the invention.

The embodiment described above concerns mascara applicators, but these characteristics can be applied to other types of cosmetic product applicator such as nail polish applicators or cosmetic product applicators for the eyebrows or the hair.

An applicator could have supports distributed in a uniform manner but on which the protuberances are distributed in a non-uniform manner.

An applicator could also have identical supports, each having protuberances organised in the same way, these supports being distributed in a non-uniform manner along the longitudinal axis of the applicator.

The applicator could also have an exoskeletal structure.

An applicator could comprise supports having at least three holes, each having a different main opening direction.

The invention claimed is:

1. Cosmetic product applicator comprising:

protuberances, and supports including at least three supports which support said protuberances, the supports being arranged in a non-uniform manner along a longitudinal axis of said applicator wherein at least one of the supports comprises at least two through-holes, at least one of the supports is formed by a branching of branches, the branching forming the at least two through-holes;

wherein the supports are made along the longitudinal axis of the applicator and at least two of the supports one after the other form a cell between them, the cell crosses a longitudinal axis of the applicator and comprises at least two cells which communicate with each other via at least one of the at least two through-holes in one of the supports.

2. Applicator according to claim 1, wherein all the supports are selected from the group consisting of having a dimension that is different from others of the support, a shape that is different from others of the supports and combinations thereof.

3. Applicator according to claim 1, wherein at least one of the supports is selected from the group consisting of: having no axis of symmetry, having no plane of symmetry, having a non-planar face and combinations thereof.

4. Applicator according to claim 1, wherein all the supports have a non-ruled face.

5. Applicator according to claim 1, wherein at least one of the supports is generally leaf-shaped.

6. Applicator according to claim 1, wherein the supports are distributed in pairs of adjacent supports along the longitudinal axis of the applicator, each support being closer to the support of the same pair than the other supports.

7. Applicator according to claim 1, wherein the protuberances form a generally curved shape or a straight shape and extend from the support.

8. Applicator according to claim 1, wherein the protuberances extending from a same support are selected from the group consisting of: not forming a repetitive pattern not being arranged in the same way as the protuberances of the other supports and combinations thereof.

9. Applicator according to claim 1, wherein the applicator is selected from the group consisting of: having no axis of symmetry, having no plane of symmetry and combinations thereof.

10. Applicator according to claim 1, wherein the applicator has no core.

11. Applicator according to claim 1, wherein the applicator has an open cell foam structure.

12. Applicator according to claim 1, wherein the applicator is made in one piece.

13. Cosmetic article comprising an applicator according to claim 1.

14. Method of manufacturing by additive synthesis comprising the following steps:

obtaining data concerning an applicator; and performing additive synthesis of the applicator using the data wherein the applicator comprises:

protuberances, and supports including at least three supports which support said protuberances, the supports being arranged in a non-uniform manner along a longitudinal axis of said applicator wherein at least one of the supports comprises at least two through-holes, at least one of the supports is formed by a branching of branches, the branching forming the at least two through-holes;

wherein the supports are made along the longitudinal axis of the applicator and at least two of the supports one after the other form a cell between them, the cell crosses a longitudinal axis of the applicator and comprises at least two cells which communicate with each other via at least one of the at least two through-holes in one of the supports.

15. A computer file comprising data that can be used by a computer program to control the implementation of a computer implemented method, the computer implemented method comprising:

obtaining data concerning an applicator; and performing additive synthesis of the applicator using the data wherein the applicator comprises:

protuberances, and supports including at least three supports which support said protuberances, the supports being arranged in a non-uniform manner along a longitudinal axis of said applicator wherein at least one of the supports comprises at least two through-holes, at least one of the supports is formed by a branching of branches, the branching forming the at least two through-holes;

wherein the supports are made along the longitudinal axis of the applicator and at least two of the supports one after the other form a cell between them, the cell crosses a longitudinal axis of the applicator and comprises at least two cells which communicate with each other via at least one of the at least two through-holes in one of the supports.

16. The computer file of claim 15 wherein the computer file is stored on an electronic storage medium comprising stored data to implement the method.

17. The computer file of claim 15 wherein the computer file is provided by download on a telecommunication network.

* * * * *